US008678888B2

(12) United States Patent
Levasseur et al.

(10) Patent No.: US 8,678,888 B2
(45) Date of Patent: Mar. 25, 2014

(54) COIN STORAGE CASSETTE

(75) Inventors: Joseph L. Levasseur, Chesterfield, MO (US); Michael A. Nogin, Creve Coeur, MO (US); Ian F. Murphy, Crestwood, MO (US); Jack R. Hoffmann, Jr., St. Louis, MO (US); Wayne T. Biermann, Brentwood, MO (US); Chad P. Stuemke, St. Louis, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 497 days.

(21) Appl. No.: 11/778,514

(22) Filed: Jul. 16, 2007

(65) Prior Publication Data

US 2008/0014850 A1 Jan. 17, 2008

Related U.S. Application Data

(60) Provisional application No. 60/807,422, filed on Jul. 14, 2006.

(51) Int. Cl.

| | |
|---|---|
| ***G07D 1/00*** | (2006.01) |
| ***G07D 9/06*** | (2006.01) |
| ***G07F 11/54*** | (2006.01) |
| ***G07F 9/10*** | (2006.01) |

(52) U.S. Cl.

USPC ..... 453/18; 312/212

(58) Field of Classification Search

USPC ..... 453/18, 61, 63; 312/201, 211, 212, 266, 312/269; 232/1 D, 4 R, 9, 43.2, 44

See application file for complete search history.

(56) References Cited

U.S. PATENT DOCUMENTS

| | | | | |
|---|---|---|---|---|
| 3,941,138 | A | 3/1976 | Woodhouse | |
| 4,469,245 | A | 9/1984 | Fish et al. | |
| 5,400,891 | A | 3/1995 | Winstanley | |
| 5,902,178 | A * | 5/1999 | Perkitny | 453/9 |
| 6,086,473 | A * | 7/2000 | Hayashi et al. | 453/37 |
| 8,517,163 | B2 * | 8/2013 | Quattrini et al. | 194/302 |
| 2004/0198210 | A1 * | 10/2004 | Meyer-Weingaertner | 453/17 |
| 2004/0259490 | A1 * | 12/2004 | Hino et al. | 453/3 |

OTHER PUBLICATIONS

PCT/US2007/073612 Written Opinion dated Dec. 18, 2007.
PCT/US2007/073612 International Search Report.

* cited by examiner

*Primary Examiner* — Mark Beauchaine
(74) *Attorney, Agent, or Firm* — Polster Lieder Woodruff & Lucchesi, L.C.

(57) ABSTRACT

A cassette having a plurality of coin stores for storing and dispensing coins in a coin changer, the coin stores arranged in a plurality of rows of coin stores, and a coin reject path for transporting coins that have been rejected by the coin changer, the coin reject path being disposed between rows of the coin stores.

25 Claims, 8 Drawing Sheets

COIN STORAGE CASSETTE

The present application claims priority to U.S. Provisional Patent Application Ser. No. 60/807,422 that was filed Jul. 14, 2006. The contents of such application is incorporated herein by reference.

FIELD OF THE INVENTION

The present invention relates to coin changers and more particularly to a cassette for a coin changer having coin stores for making change.

BACKGROUND OF THE INVENTION

Various designs of cassettes for coin changers having various coin stores for payout have been proposed. The coin stores are sized to accept a certain diameter of coin and several are associated with the cassette to store coins of particular varieties. Several coin stores of the same size may be associated with a single cassette to increase the storage capacity of coins of that size.

In the past, cassettes have been manufactured that are permanently configured to incorporate coin stores of certain diameters. Other cassettes have been manufactured to incorporate removable coin stores that allow the coin stores to be replaced with a coin store of a different diameter. Reconfiguring the diameter of a coin store, and hence the denomination of coin that it will contain, requires the coin changer to be reconfigured in order that it may accurately calculate the change to be given a customer. The reconfiguration can be manual or automatic.

A removable cassette for a coin changer is disclosed in U.S. Pat. No. 5,400,891. The cassette has coin storage modules that are retained in the cassette. However, no coin storage module can be removed from the cassette until the cassette has been removed from the coin changer. This represents a deficiency in the prior art as it would be simpler for a technician to have the capability to remove and replace the coin stores while the cassette was attached to coin changer.

SUMMARY OF THE INVENTION

The present invention provides a cassette comprising a plurality of coin stores for storing and dispensing coins in a coin changer, the coin stores arranged in a plurality of rows of coin stores, and a coin reject path for transporting coins that have been rejected by the coin changer, the coin reject path being disposed between rows of the coin stores.

BRIEF DESCRIPTION OF THE DRAWINGS

Referring now to the drawings in which like reference numbers represent corresponding parts throughout.

DETAILED DESCRIPTION OF PREFERRED EMBODIMENT

In the following description, reference is made to the accompanying drawings which form a part hereof, and which is shown, by way of illustration, an embodiment of the present invention. It is understood that other embodiments may be utilized and structural changes may be made without departing from the scope of the present invention.

The preferred embodiment of the present invention is an apparatus that allows an operator of a coin changer having a cassette to easily load manually or to modify the coin store types without removing the cassette from the coin changer. Access to the opening of a coin reject chute which is contained within the two portions of the cassette is very simply provided.

Figure 1:
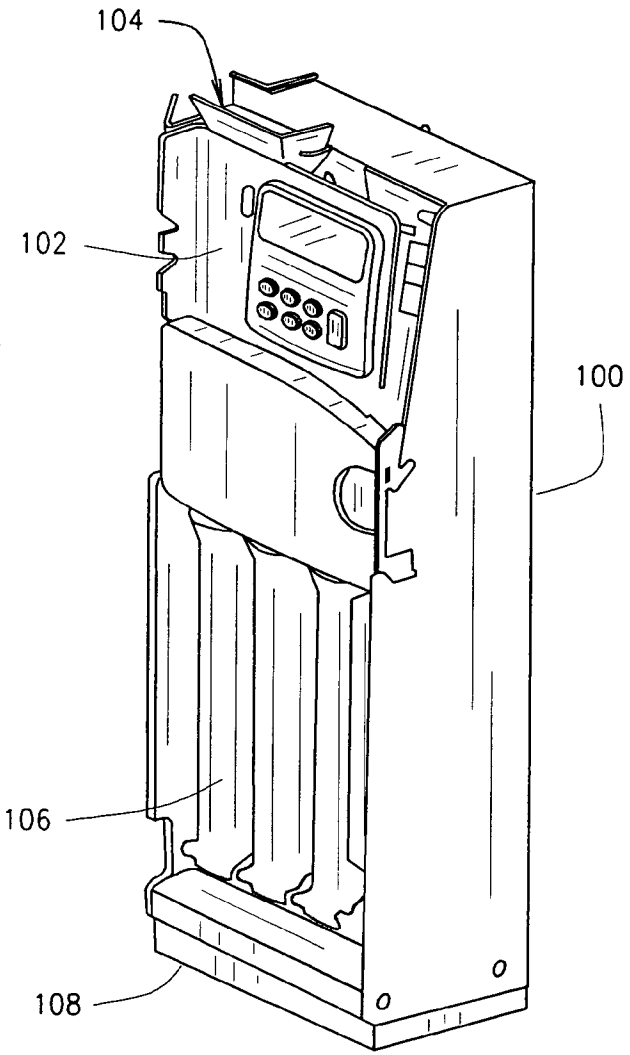
FIG. 1 is a perspective view of a coin changer according to an embodiment of the present invention.

FIG. 1 is a perspective view of a coin changer housing 100 with its coin acceptor 102, a coin intake funnel 104, a cassette 106, and a payout base 108.

Figure 2:
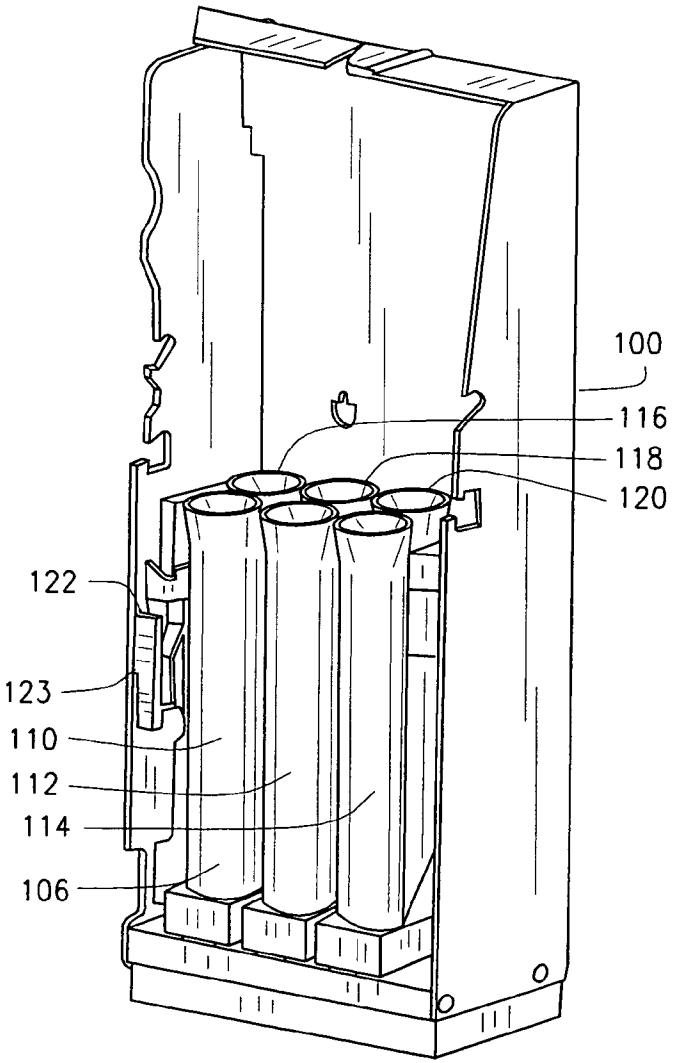
FIG. 2 is a perspective view of a coin changer with the coin acceptor portion removed according to an embodiment of the present invention.

Referring to FIG. 2, there is shown a coin changer housing 100 with the coin acceptor 102 removed, thereby giving a clear view of the top portion of the cassette 106 showing six coin stores 110, 112, 114, 116, 118, and 120. A cam 122 is rotatably mounted to the coin changer housing 100. A cassette lift pin 123 is associated with the cassette 106.

Figure 3:
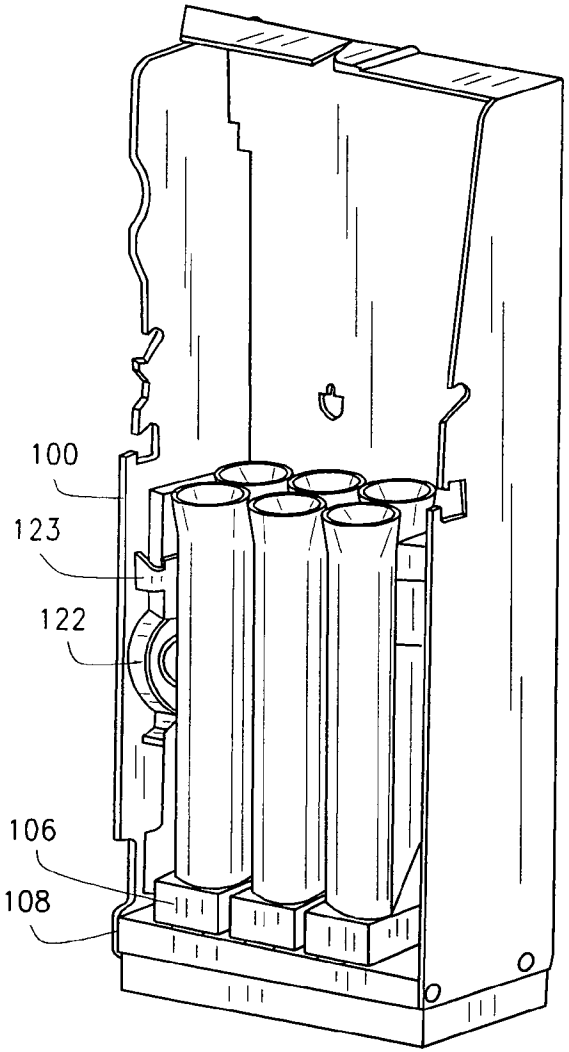
FIG. 3 is a perspective view of a coin changer with the coin acceptor portion removed according to an embodiment of the present invention raised up from the payout base.

In FIG. 3, the cassette 106 is lifted up from the payout base 108 by the rotation of the cam 122 attached to the coin changer housing 100. This provides clearance for the cassette to pivot outward, as shown below.

Figure 4:
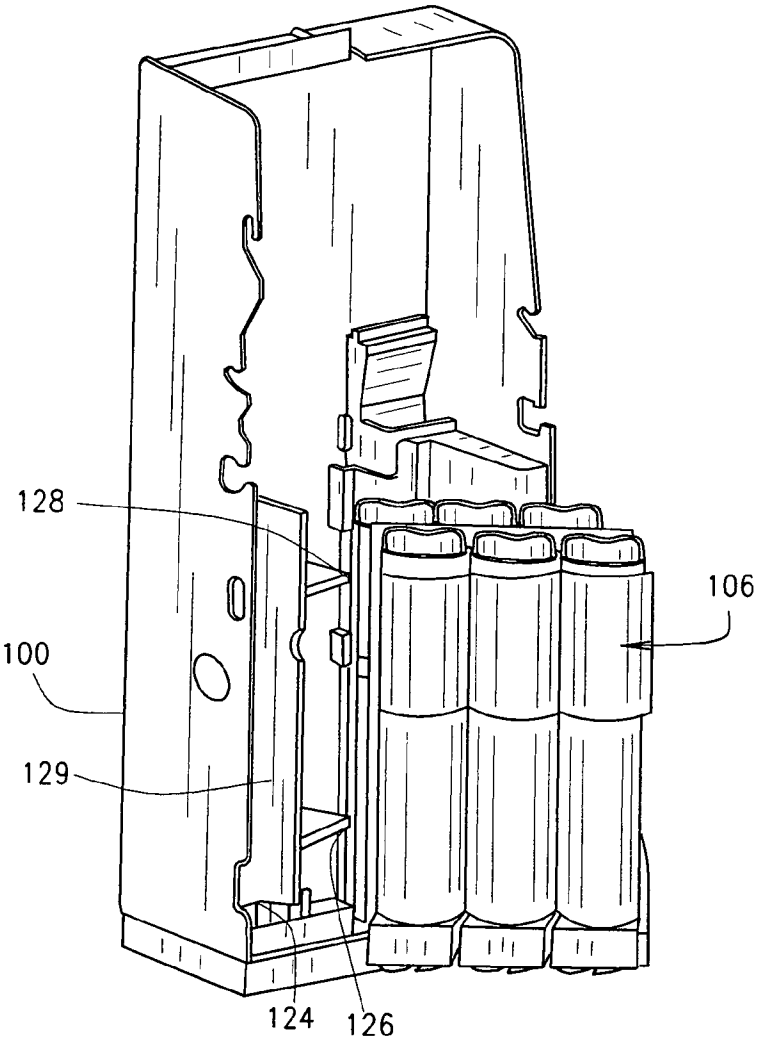
FIG. 4 is a perspective view of a coin changer with the coin acceptor portion removed according to an embodiment of the present invention with a cassette portion pivoted from the changer housing.

In FIG. 4, the cassette 106 is pivoted outward on the articulated hinge 124 at hinge points 126 and 128. The articulated hinge 124 hinges its other side 129 at two points attached to the housing 100 where it is lifted up by the cam 122 shown in FIG. 3. The cassette 106 can be removed by lifting upwards and off from the hinge points 126 and 128 after it is pivoted outward. The articulated (offset) hinge 124 folds back out of the way, between the housing 100 and the cassette 106.

Figure 5:
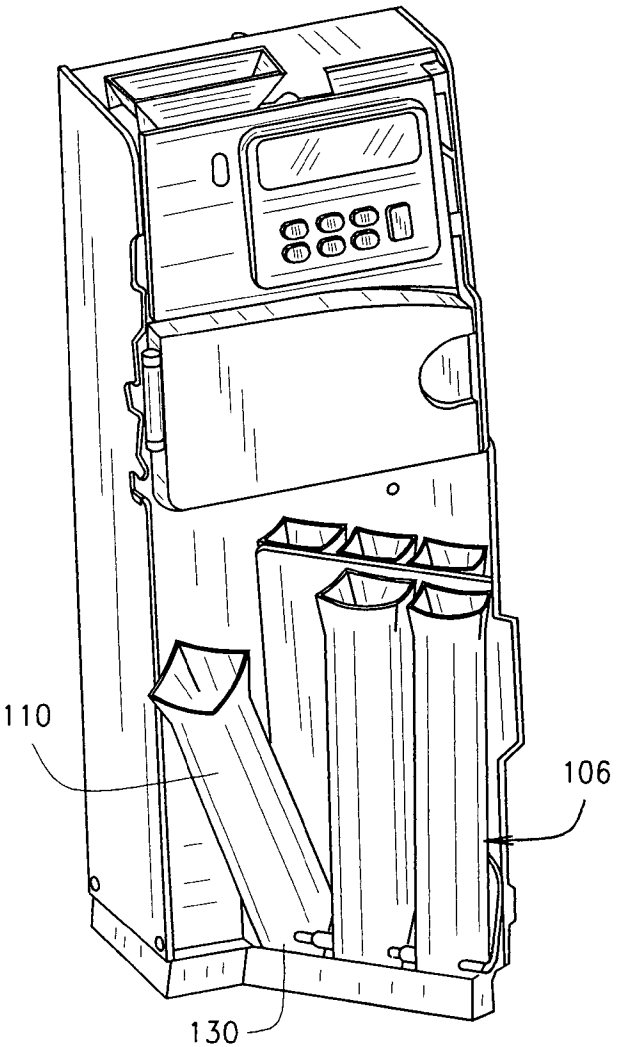
FIG. 5 is a perspective view of a coin changer with the coin acceptor portion removed according to an embodiment of the present invention with a cassette portion pivoted from the changer housing and a coin store pivoted from the cassette.

Referring to FIG. 5, coin store 110 is in the removable position as it is tilted outward from its vertical position from the cassette 106, and then unsnapped by pulling from its rotation pivot point 130.

Figure 6:
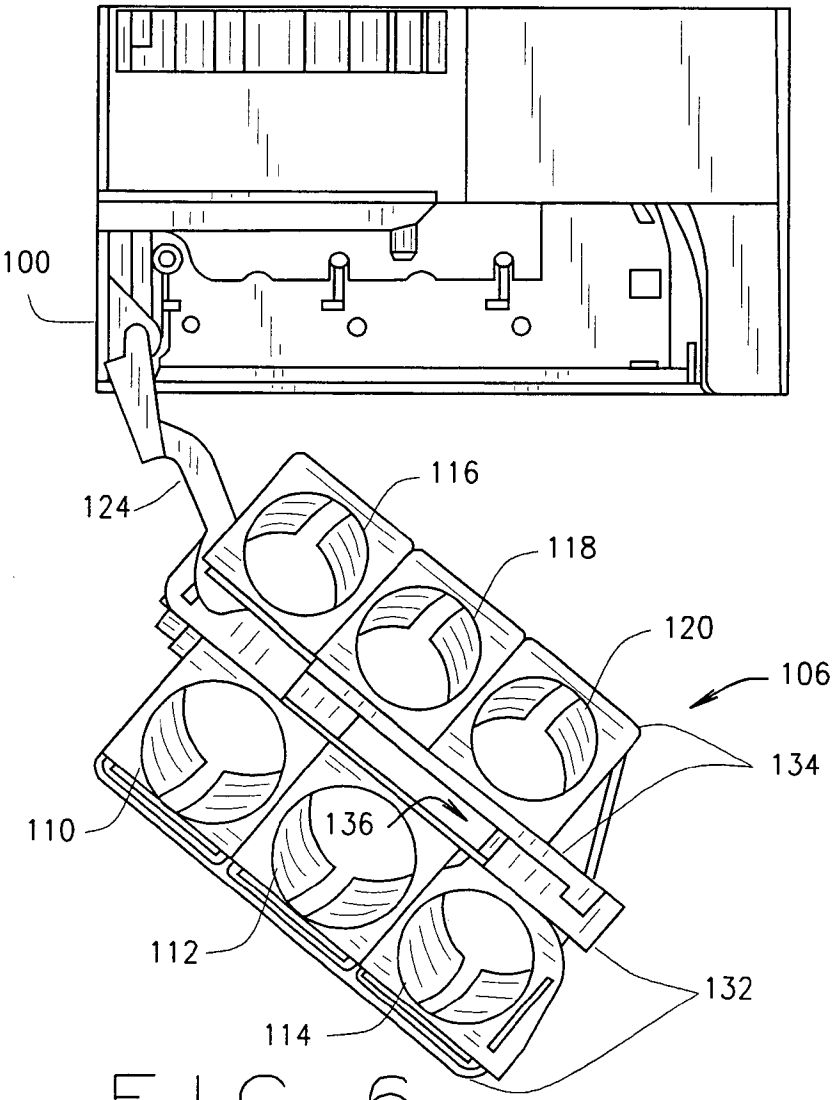
FIG. 6 is a top view of a coin changer according to an embodiment of the present invention with a cassette pivoted from the changer housing.

FIG. 6 shows a top view of the cassette 106 when pivoted outward from the coin changer housing 100 and supported by articulated hinge 124 from the said housing 100. The cassette 106 with the front support 132 with its three coin stores 110, 112, and 114 and the rear support 134 with its three coin stores 116, 118, and 120 are connected together by the articulated hinge 124, and when closed together provide the coin reject chute 136. When opened the cassette 106 provides easy removal of objects that may become jammed. The articulated hinge 124 connects the cassette 106 to the coin changer housing 100 to provide easy access to fill or to change the coin stores.

Figure 7:
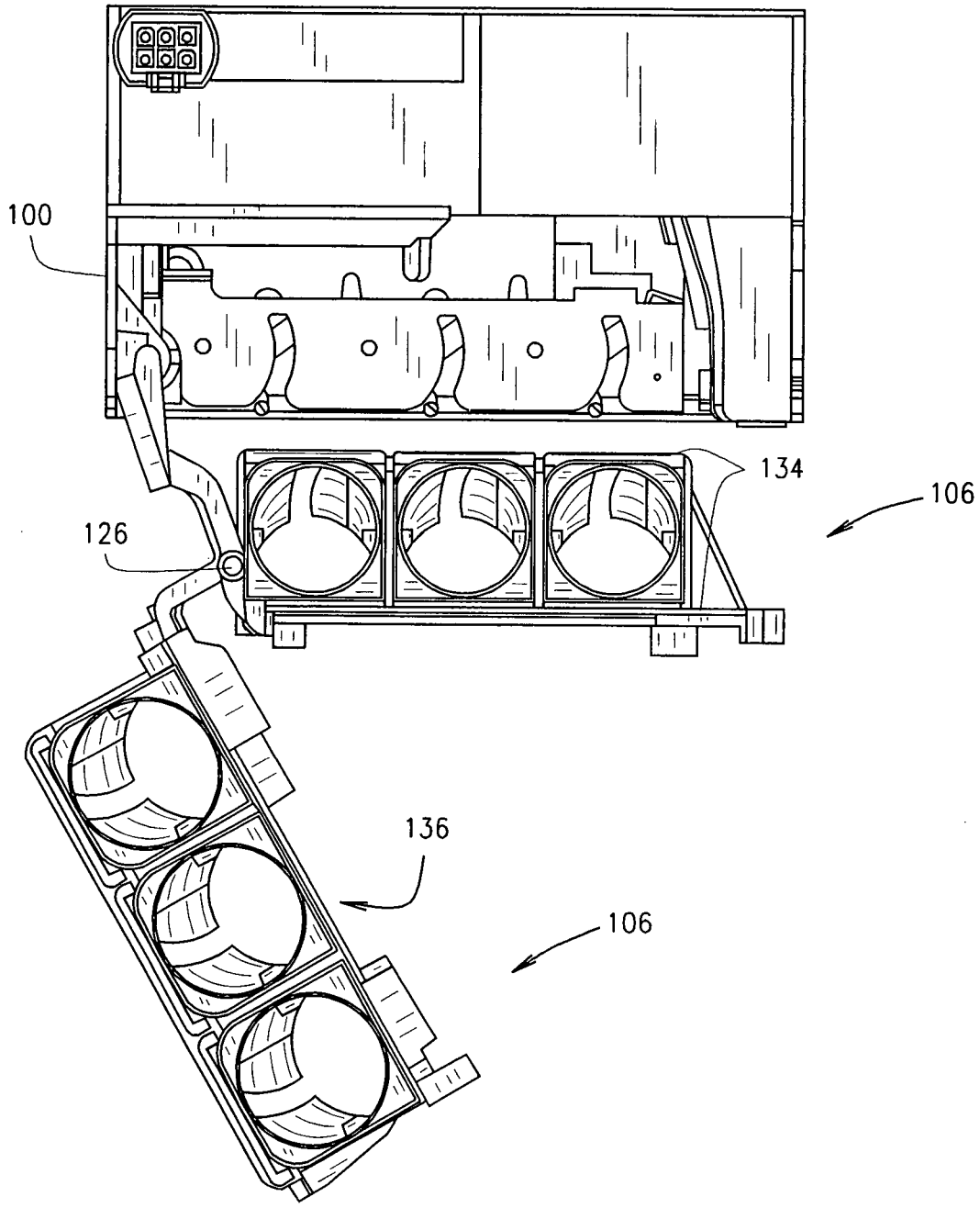
FIG. 7 is a top view of a coin changer according to an embodiment of the present invention with a cassette pivoted from the changer housing and two portions of the cassette pivoted away from one another.

FIG. 7 is a drawing of a top view of the coin changer housing 100 with the cassette 106 front support 132 opened from its rear support 134 and hinged at point 126 showing the coin reject chute 136 in the cassette 106 is in the opened position.

Figure 8:
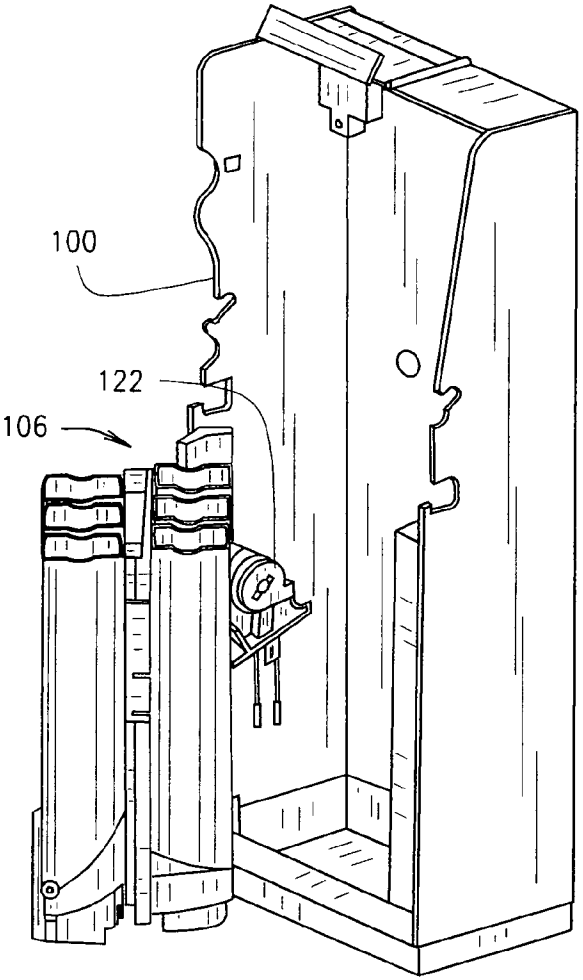
FIG. 8 is a view of a cam that is rotated to lift a cassette from a payout base according to an embodiment of the present invention.

FIG. 8 shows the cam 122 attached to the housing 100 which lifts the cassette 106 from with a recess 137 of the payout base 108 as the cam 122 is rotated. The cam 122 lifts the cassette 106 by acting upon the cassette lift pin 123. When the cassette 106 is lifted, this permits the cassette 106 to be pivoted outwardly from the housing 100. When the cassette 106 is returned into the housing, the cam 122 automatically locks the cassette 106 in an operational position.

Figure 9:
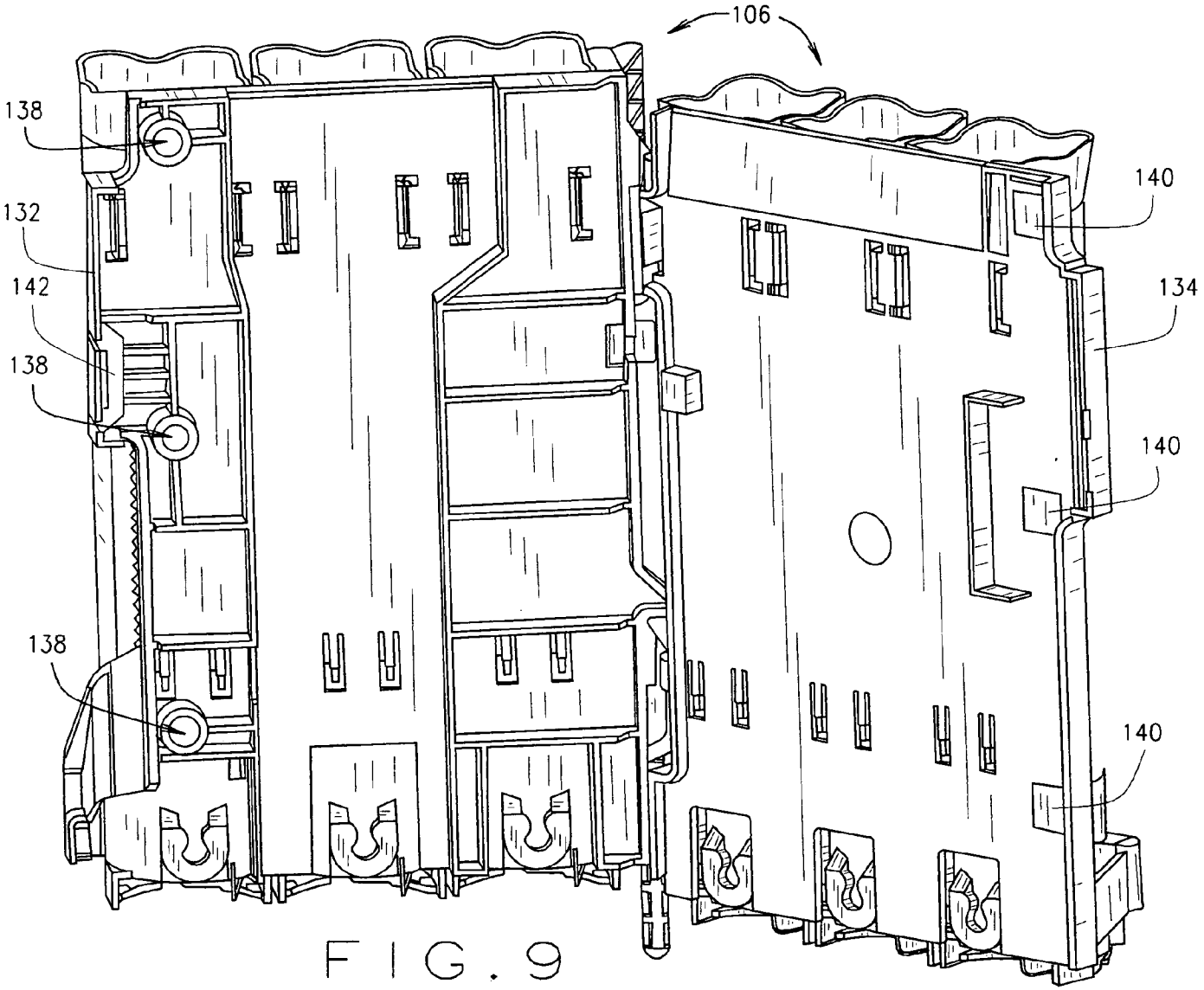
FIG. 9 is a view of two cassette portions pivoted from each other according to an embodiment of the present invention.

FIG. 9 is a drawing of the front support 132 and the rear support 134 of the cassette 106 showing magnet positions 138 and their related ferrous metal holders 140 which cooperate to hold the two supports 132 and 134 together. A clear prism 142 provides an optical path that is completed when the cassette 106 is correctly positioned as described in U.S. Provisional Patent Application Ser. Nos. 60/806,894 and 60/889,698. The contents of such applications are incorporated herein by reference.

Figure 10:
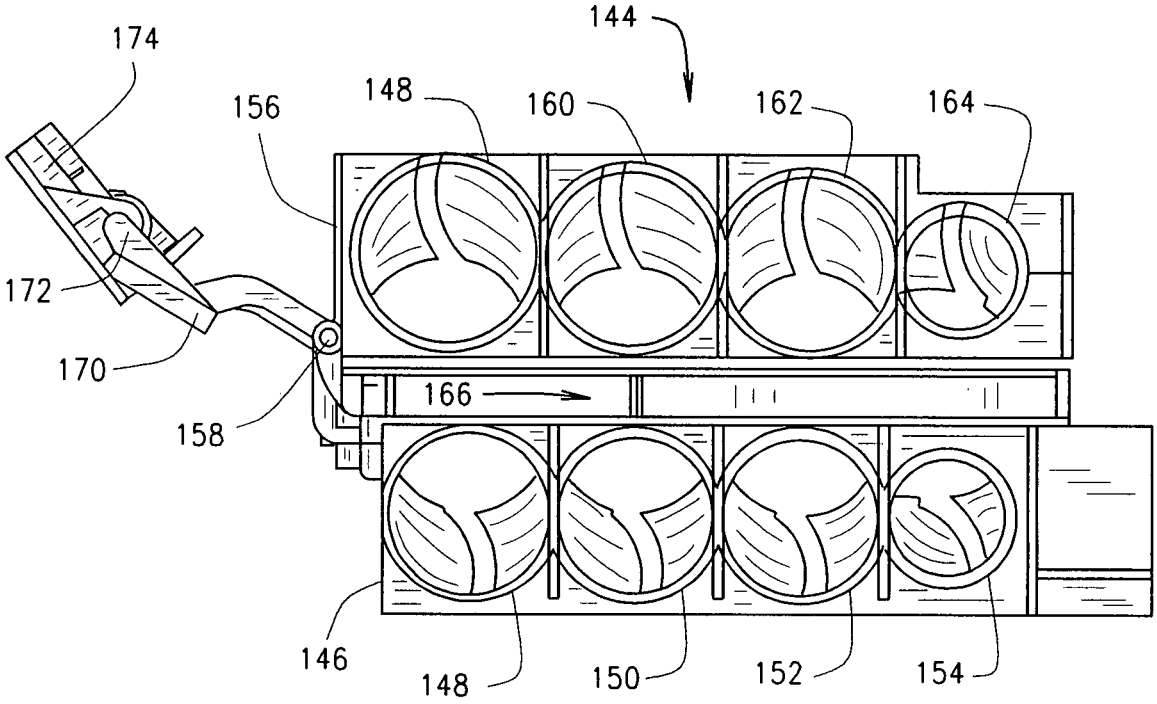
FIG. 10 is a partial top view of a coin changer according to an alternative embodiment of the present invention.

FIG. 10 is a simplified drawing showing a top view of an alternative embodiment of a cassette 144 with a front support 146 with four interdependent coin stores 148, 150, 152, and 154 and a rear support 156 of four interdependent coin stores 158, 160, 162, and 164. A coin reject path 166 is located between the two supports 146 and 156. A hinge point 168 is the pivot point for the front and rear supports 146 and 156 as well as a first point of an articulated hinge 170, as described above. A second hinge point of the articulated hinge 170 is at a second point 172 which is shown attached to a coin changer portion or body 174.

Figure 11:
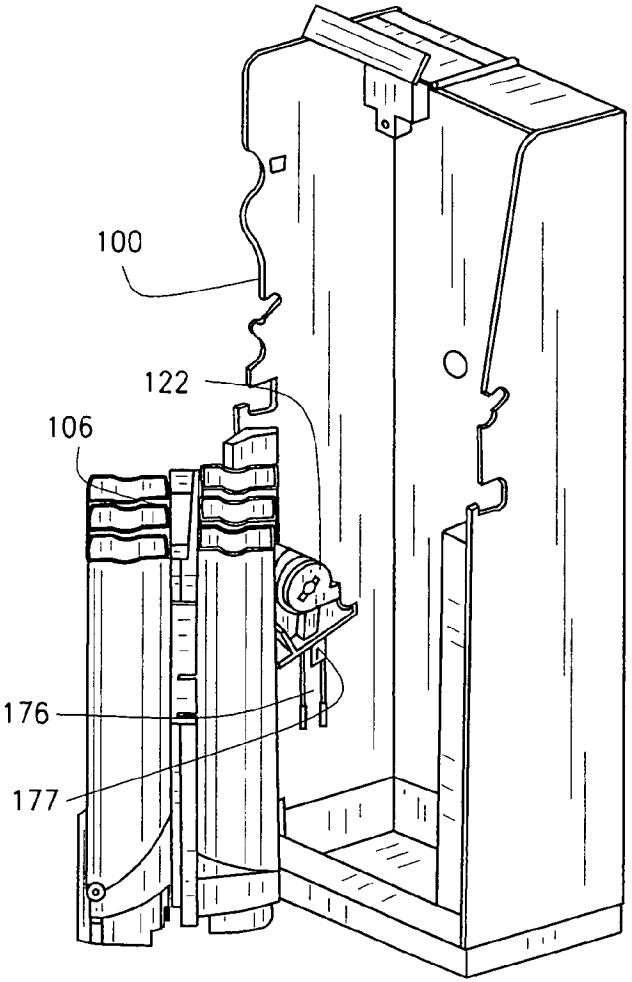
FIG. 11 is an alternate view of FIG. 8 showing rotated cam device locked in the position by the latch.

FIG. 11 shows the cam 122, which lifted the cassette 106 and is locked in this position by latch 176 incorporated into the housing 100. Latch 176 catches the cam 122 to hold it in the open position as shown in FIG. 11. When the cassette 106 is swung back into position, the cassette 106 contacts a protuberance 177 thereby resiliently deflecting the latch and releasing cam 122.

Figure 12:
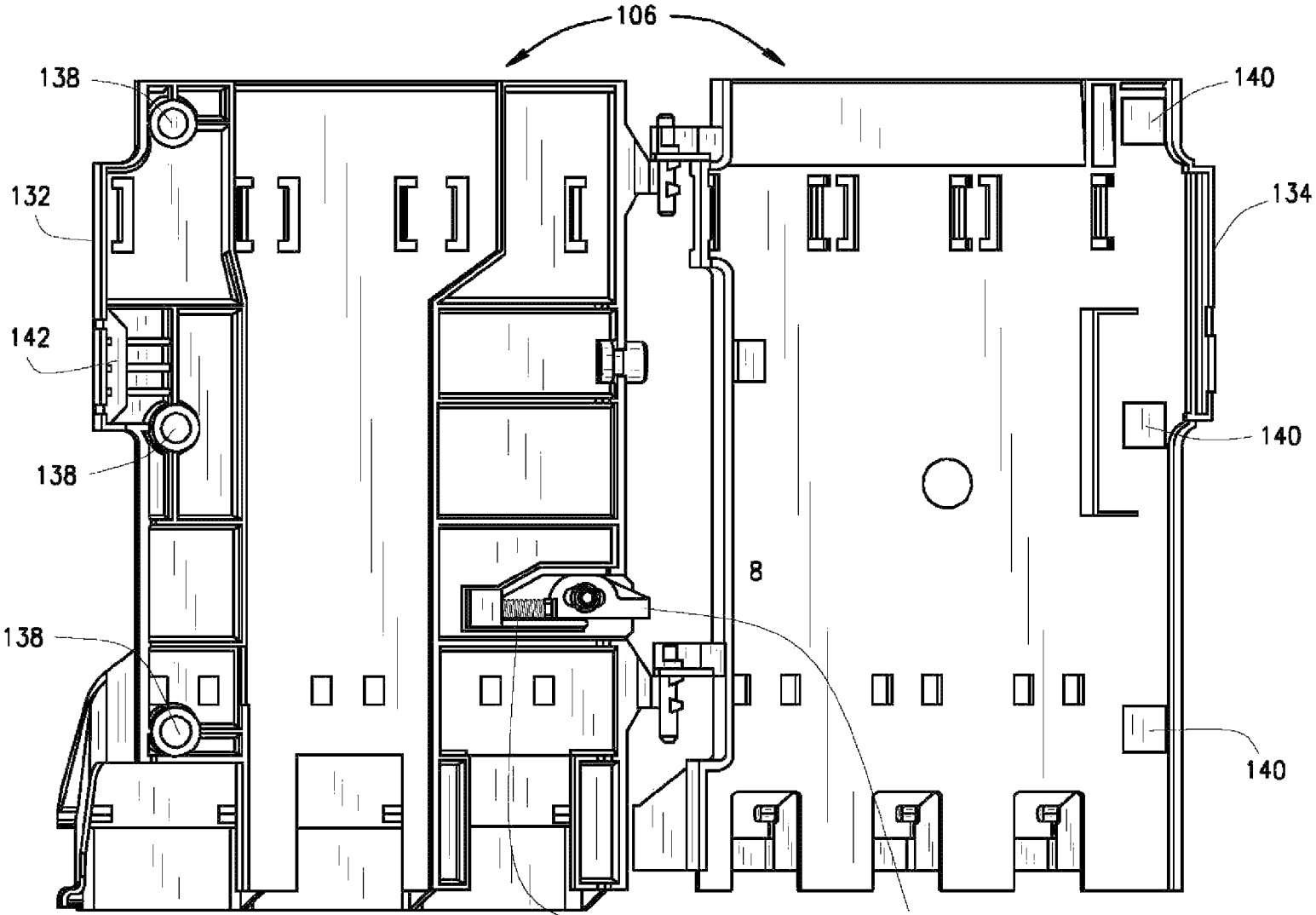
FIG. 12 is an alternate view of FIG. 9 showing two cassette portions with a trigger and spring for operation of the latch.

FIG. 12 shows the trigger 180 installed in the cassette 106 and supported by spring mechanism 178. When the cassette 106 is in the lifted position and swung toward the cam, trigger 180, supported by spring 178, pushes on the latch 176 and unlocks the cam 122. Then trigger 176 stays collapsed due to interaction with the latch feature and a spring's 178 ability to resiliently deflect.

The forgoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by the details of the embodiments presented in this description. The above specification, examples, and data provide a complete description of the manufacture and use of the invention. Many embodiments of the invention can be made without departing from the spirit and scope of the invention.

What is claimed is:

1. A cassette comprising:

a plurality of coin stores for storing and dispensing coins in a coin changer, the coin stores arranged in a plurality of rows of coin stores, a coin reject path for transporting coins that have been rejected by the coin changer, the coin reject path being disposed between rows of the coin stores;

wherein the cassette comprises a front support and a rear support and wherein the front support and rear support each, respectively, support a first and second row of coin stores of the plurality of coin stores, and wherein the coin reject path is located between the front and rear supports; and wherein the front support and rear support are pivotally attached to one another by an interconnecting hinge.

2. The cassette of claim 1 wherein one of the front support and the rear support of the cassette comprises one or more magnets and the other of the front support and the rear support of the cassette comprise a magnetically attractive material which cooperates with the magnetic to maintain the front support and the rear support of the cassette in a fixed position with respect to one another.

3. A cassette comprising:

a plurality of coin stores for storing and dispensing coins in a coin changer, the coin stores arranged in a plurality of rows of coin stores, a coin reject path for transporting coins that have been rejected by the coin changer, the coin reject path being disposed between rows of the coin stores; and an articulated hinge attaching the plurality of rows of coin stores to the coin changer that allows the cassette to be rotated about at least one vertical axis for removal from the coin changer.

4. The cassette of claim 3 further comprising means for removably attaching the coin stores to the cassette.

5. The cassette of claim 3 further comprising means for removably attaching the coin stores to the cassette by first tipping a top portion of the coin store away from the front or rear support.

6. The cassette of claim 5 wherein the means for removably attaching the coin stores allows for the removal of at least one coin store without removal of the cassette from the coin changer.

7. The cassette of claim 3 further comprising a cam attached to the coin changer that lifts the cassette from a recess within a coin payout base.

8. The cassette of claim 7 wherein the cam locks the cassette into an operational position.

9. The cassette of claim 3 further comprising means for sensing proper positioning of said cassette.

10. The cassette of claim 3 wherein the plurality of rows of coin stores comprises two rows of coin stores each comprising three coin stores.

11. The cassette of claim 3 wherein the plurality of rows of coin stores comprises two rows of coin stores each comprising four coin stores.

12. A cassette comprising:

a plurality of coin stores for storing and dispensing coins in a coin changer, the coin stores arranged in a plurality of rows of coin stores, a coin reject path for transporting coins that have been rejected by the coin changer, the coin reject path being disposed between rows of the coin stores, the cassette further comprising a front support and a rear support wherein the front support and rear support each, respectively, support a first and second row of coin stores of the plurality of coin stores, and wherein the coin reject path is located between the front and rear supports; and wherein the front support and rear support are pivotally attached to one another by an interconnecting hinge.

13. The cassette of claim 12 further comprising means for removably attaching the coin stores to the cassette.

14. The cassette of claim 12 further comprising means for removably attaching the coin stores to the cassette by first tipping a top portion of the coin store away from the front or rear support.

15. The cassette of claim 14 wherein the means for removably attaching the coin stores allows for the removal of at least one coin store without removal of the cassette from the coin changer.

16. The cassette of claim 12 further comprising a cam attached to the coin changer that lifts the cassette from a recess within a coin payout base.

17. The cassette of claim 16 wherein the cam locks the cassette into an operational position.

18. The cassette of claim 12 further comprising means for sensing proper positioning of said cassette.

19. The cassette of claim 12 wherein the plurality of rows of coin stores comprises two rows of coin stores each comprising three coin stores.

20. The cassette of claim 12 wherein the plurality of rows of coin stores comprises two rows of coin stores each comprising four coin stores.

21. The cassette of claim 12 wherein one of the front support and the rear support of the cassette comprises one or more magnets and the other of the front support and the rear support of the cassette comprise a magnetically attractive material which cooperates with the magnetic to maintain the front support and the rear support of the cassette in a fixed position with respect to one another.

22. A cassette comprising a plurality of coin stores for storing and dispensing coins in a coin changer, the coin stores arranged in a plurality of rows of coin stores, a coin reject path for transporting coins that have been rejected by the coin changer, the coin reject path being disposed between rows of the coin stores, the cassette further comprising a front support and a rear support wherein the front support and rear support each, respectively, support a first and second row of coin stores of the plurality of coin stores, and wherein the coin reject path is located between the front and rear supports; and an articulated hinge attaching the plurality of rows of coin stores to the coin changer that allows the cassette to be rotated about at least one vertical axis for removal from the coin changer.

23. A cassette comprising:

a plurality of coin stores for storing and dispensing coins in a coin changer, the coin stores arranged in a plurality of rows of coin stores, wherein the cassette comprises a front support and a rear support and wherein the front support and rear support each, respectively, support a first and second row of coin stores of the plurality of coin stores, and wherein a coin reject path is located between the front and rear supports; and a latch to lock a cam in the position whereby the cassette is maintained in a lifted position to allow rotation of the cassette.

24. The cassette of claim 23 wherein the latch is adapted to interact with a protuberance located on a coin changer housing to unlock and allow rotation of the cam whereby the cam locks the cassette in the ready-to-dispense position.

25. The cassette of claim 23 wherein a trigger comprises a spring mechanism inside the cassette that pushes on the latch when the cassette is in an elevated position, and collapses when the cassette is moving into the ready to dispense position.

* * * * *